United States Patent [19]

Wurtz

[11] Patent Number: 4,619,381

[45] Date of Patent: Oct. 28, 1986

[54] METHOD AND APPARATUS FOR DISCHARGING MATERIALS FROM A STORAGE BIN

[75] Inventor: William O. Wurtz, Paramus, N.J.

[73] Assignee: Willow Technology, Inc., Paramus, N.J.

[21] Appl. No.: 678,893

[22] Filed: Dec. 6, 1984

[51] Int. Cl.[4] ..... G01F 11/00

[52] U.S. Cl. ..... 222/272; 222/281; 222/333; 222/342; 222/411; 222/412; 222/413; 366/85; 366/156; 366/186

[58] Field of Search ..... 222/310, 311, 564, 239, 222/240, 241, 242, 410–413, 342, 238, 236, 272, 271, 280, 281, 333; 366/134, 156, 157, 158, 186, 271, 83, 84, 85, 81; 198/669, 662

[56] References Cited

U.S. PATENT DOCUMENTS

| | | | |
|---|---|---|---|
| 1,095,383 | 5/1914 | Cole | 222/238 |
| 1,288,025 | 12/1918 | Kennedy | 222/280 |
| 3,276,633 | 10/1966 | Rahauser | 222/239 X |
| 3,941,357 | 3/1976 | Wurtz | 366/91 |

*Primary Examiner*—Joseph J. Rolla
*Assistant Examiner*—David H. Bollinger
*Attorney, Agent, or Firm*—Collard, Roe & Galgano

[57] ABSTRACT

There is provided a method and apparatus for discharging storage bins within which difficult-to-handle materials are stored, the apparatus including a container adapted to be fixed to the bottom of the storage bin or silo, having horizontally spaced apart parallel shafts disposed within the container for counter-rotational movement therebetween. Working tools are attached to the shafts by radially extending arms and extend toward and substantially up to the side walls of the container. The working tools are double wedge shaped having substantially triangularly shaped sides converging toward each other at their connection to the shafts and converging toward each other to define a forward or leading edge in the direction of rotation of the tool. The bottom surfaces of the tools are recessed from the bottom edges of the triangularly shaped sides. The parallel adjacent shafts are arranged so that the paths of the working tools of each shaft overlap so that the tools mounted on each shaft come in proximity to the adjacent shaft thereby creating an overlapping zone of interaction for positive movement of material with uniform rate of shear. In order to convey material toward a discharge or an out-feed opening, the working tools are asymmetrically designed to induce material flow toward the opening.

15 Claims, 6 Drawing Figures

FIG.2
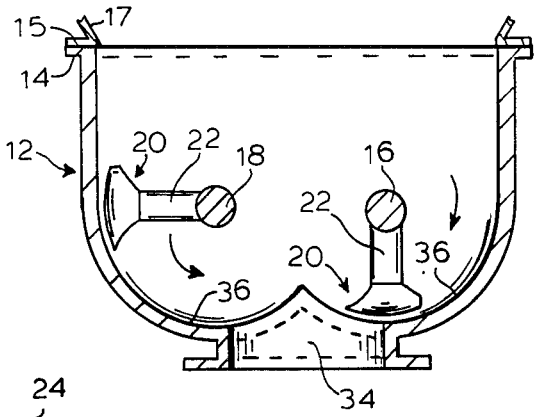
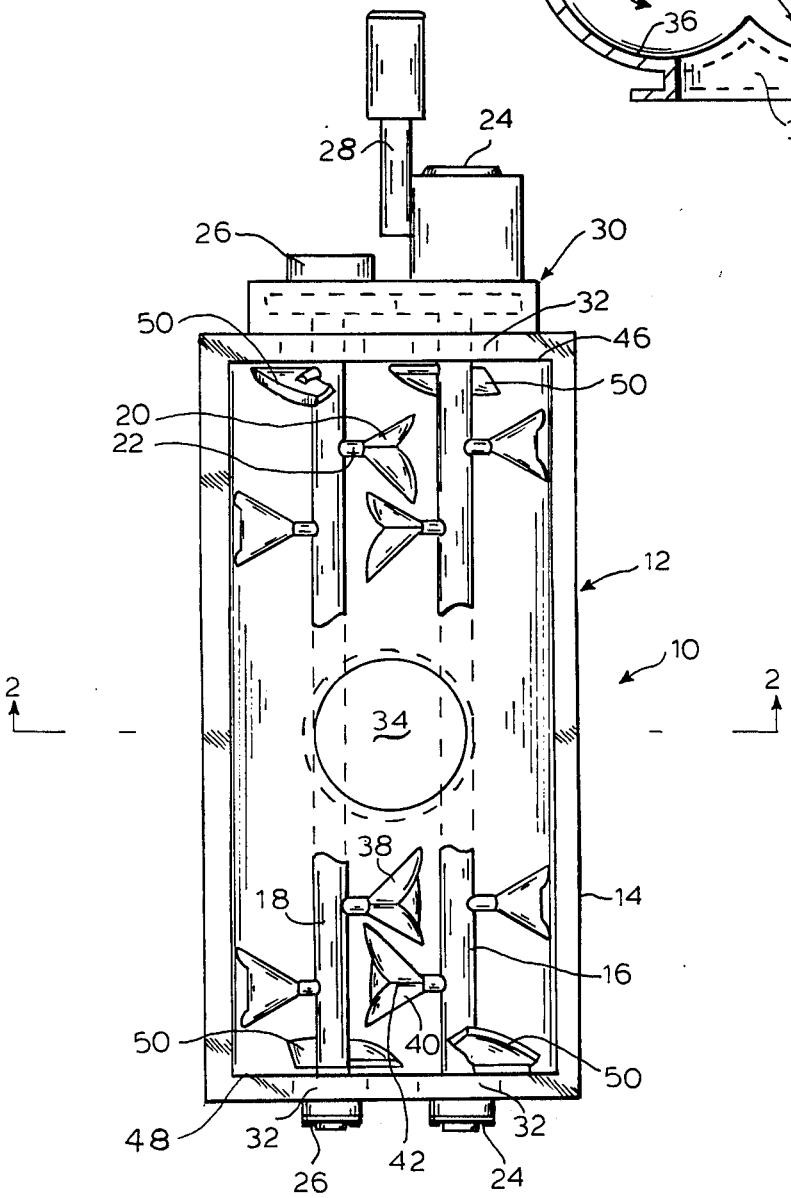
FIG.1

METHOD AND APPARATUS FOR DISCHARGING MATERIALS FROM A STORAGE BIN

The present invention relates to a method and apparatus for discharging materials, particularly difficult-to-handle materials, from storage bins. More specifically, the present invention relates to a method and apparatus which is well suited for mechanically inducing continuous, dependable flow of such materials from storage bins at fixed flow rates or at controlled, variable flow rates. Such difficult-to-handle or difficult-to-flow materials can comprise dry materials or dry blends of materials that tend to classify in material handling equipment by virtue of variations in particle size, shape or weight; damp or wet materials; fibrous materials; cohesive materials; sludge; composted materials with or without bulking agents; or heavy, viscous, shear sensitive, non-Newtonian materials with or without fillers or fibers.

The retrieval of materials from storage bins and the promotion of continuous, dependable flow of such above described difficult-to-handle materials to downstream process machines have presented problems to industry. Many such materials cannot be made to flow uniformly from storage bins to mixers, dryers, size reduction machines and other similar devices. In such cases, material flow is affected by changes and variations in bulk densities caused by aeration or deaeration, classification of individual particles, particle size, shape, weight, distribution, moisture content and cohesiveness. Additionally, many existing as well as new storage bins are designed for economy of fabrication and acceptable head room rather than the promotion of material flow. These cumulative factors often result in no-flow conditions when attempting to discharge or feed such difficult-to-handle materials. One such no-flow condition is called "bridging" where the material arches across the discharge opening. Another no-flow condition is termed "coring" which occurs in systems where a cylindrically shaped void approximately equal in diameter to and positioned over the bin bottom discharge opening develops and the material flows from the top level of the bin into the void. In such a situation, a no-flow condition occurs when the material fails to slough off of the top layer of material in the bin. The material flow in these types of systems is called "plug flow" which is a non-uniform discharge of the storage bin.

In addition to the "plug flow" problems of bridging and coring, materials with the aforementioned characteristics also develop storage bin emptying or flow problems relating to classification, variations in bulk density or specific gravity, or changes in material characteristics, such as changes in viscosity with respect to wet materials.

The most desirable means of moving such hard-to-handle materials through storage bins is by flowing such materials under conditions approaching "mass flow". As used herein, "mass flow" through storage bins has the following characteristics:

1. The flow through the storage bin is uniform and at steady state. Bridging, coring and classification of the material does not occur. The bulk density of the material is constant to assure volumetric control of flow rates with accuracy. Aerated powders should deaerate;

2. Pressures are relatively low throughout the mass and at the walls, thereby reducing compaction and attrition of the material;

3. Substantially uniform pressures should exist across any horizontal cross section of the material;

4. Dead regions, where the material does not move, do not develop within the storage bin; and 5. First-in, first-out flow pattern is obtained which eliminates degradation due to retention and segregation of the material.

In addition to the above "mass flow" characteristics, it is necessary to provide uniform rates of shear when mechanically inducing flow, particularly for shear sensitive, non-Newtonian materials. Non-uniform rates of shear not only cause changes in the viscosity of wet, shear sensitive materials, but also can cause particle attrition, or conversely, agglomerates.

There are two types of apparatus for moving materials through storage bins to which the present invention relates. The first is a so called "bin-discharger" which operates at a fixed flow rate on a start-stop basis. The second is a so called "bin-discharger-feeder" which operates on a continuous, controlled, variable flow rate basis. There are several types of discharge apparatus of various designs and operating principles presently available and offered to industry. These various types of apparatus make use of vibrators, vibrating bin bottoms, pulsators, air jets or internally rotating mechanical flow inducers such as a single helix, multiple helices, spokes, paddles or combinations thereof.

Of the bin-dischargers of the internally rotating, mechanical flow inducing type, various arrangements are offered to industry. The most common are multiple helices located at the bottom of the bin to convey material to a discharge opening in the end of the bin-discharger. The helices may be open or closed, notched or serrated, or provided with bars or paddles to aid in the agitation and conveying action. Material delivery is through a fixed or adjustable side opening or to a collecting belt conveyor. Others are called "opposed helices" which incorporate an equal length of right hand and left hand helices on the same shaft so as to convey material to a centrally located bottom outlet in lieu of the side discharge opening. Generally, such bin-dischargers induce flow from storage bins at a constant rate.

Bin-discharger-feeders discharge bins at controlled, variable rates determined by varying the rotational speed of the helices by means of variable speed drives to increase or decrease the conveying rate of flow. Also, adjustable discharge gates which vary the area of the discharge opening are used to promote a greater or lesser volume of material to be discharged. Bin-discharger-feeders can also combine agitating helices with a conveying or feed helix. The agitating helices are usually larger in diameter than the feed helices and rotate at the same or lower speed. When an agitating helix is concentrically mounted on the same shaft as the feed helix, thus operating at the same rotational speed, it is called an "over-wrap".

All of the aforementioned bin-dischargers and bin-discharger-feeders presently offered to industry have severe limitations when handling the previously mentioned hard-to-handle materials and, with many of these materials, such equipment is not at all usable. Those skilled in the art of material handling recognize that a rotating helix will unmix and classify blended material. Another limitation is the inability to deliver wet material such as sludge or dewatered sludge accurately and without pulsations. When discharging shear sensitive, non-Newtonian materials, excessive shear force changes the characteristics of this class of material. Heavy, viscous materials, and particularly those with fillers or fibers, can severely overload the mechanical components and drive of such equipment thereby causing failure of a part of the apparatus or damage to the motor and gear mechanisms.

There are no presently available bin-dischargers or bin-discharger-feeders capable of meeting the specifications for "mass flow" when discharging hard-to-handle or hard-to-flow materials. With few exceptions, presently available bin-dischargers and bin-discharger-feeders cannot handle materials in excess of 100,000 apparent centipoises. Discharger equipment that can handle material over 100,000 centipoises cannot provide a uniform rate of shear nor prevent the mastication and breakdown of fillers or fibers contained in the material.

The applicant herein believes that the reasons for the failure of prior art discharger equipment to adequately handle hard-to-handle materials as above described are manifold. After observing such prior art equipment in operation, the applicant is of the opinion that many of the reasons for such failure can be attributed to the following:

1. Due to pressure conditions between the edge of the helix and the wall of the bin, material, and particularly compressible or fibrous materials, builds up on the wall thereby imposing an overload condition on the apparatus drive;

2. When material trapped between the edge of the helix and the wall of the bin is subjected to a high shear force, attrition of particles and mastication of fillers or fibers occurs because of the resulting pressure condition;

3. Material adheres to the helix and rotates with the helix particularly when helices are tangential, i.e. not overlapping, thereby preventing efficient and reliable material flow and resulting in inaccurate volumetric discharge;

4. Due to particle to particle friction of the material being conveyed by the helices, material is discharged through a side discharge with excess material being compressed against the wall of the bin above the discharge gate thereby causing compaction and bridging;

5. In some designs, an auxilliary helix is mounted above the discharge opening, at 90° to the conveying helices, in order to prevent the bridging mentioned above. This arrangement results in various pressures across horizontal sections of the bin, and therefore, the arrangement does not meet the above described specifications of "mass flow";

6. The material build-up on the bin walls as described above, which build-up is particularly true with compressible material, fibrous material or a combination of such materials, remains in the bin as "dead" material and is subject to deterioration;

7. Viscous, shear sensitive materials change characteristics when subjected to non-uniform rates of shear such as results from the action of helices, paddles or other conveying type dischargers. This non-uniform shear force often promotes agglomerates such as so called "sludge balls" when handling dewatered sludges.

In considering these reasons in connection with prior art discharger apparatus, it was noted that none possess the design characteristics necessary to meet the specifications for "mass flow". Also, none are adapted to prevent classification of classifiable material or provide a uniform rate of shear. All had conveying actions with limited or no "backmixing" action, that is a reflux action moving material in opposite directions, forward and backward.

It is, therefore, an object of the present invention to provide storage bin discharge apparatus for discharging at a constant rate or at a controllable rate which is adapted to mechanically induce continuous, dependable "mass flow" with uniform bulk density or specific gravity to insure accurate volumetric discharge rates from storage bins of difficult-to-handle and difficult-to-flow materials, such as classifiable material, wet or sticky material, fibrous material, viscous material, shear sensitive material or combinations thereof, having apparent viscosities exceeding 100,000 centipoises and up to 500,000 centipoises at a uniform rate of shear.

The above object, as well as others which will hereinafter become apparent, is accomplished in accordance with the present invention by the provision of a storage bin discharge apparatus which comprises a container adapted to be fixed to the bottom of a square or cylindrical type bin or silo, having horizontally spaced apart parallel shafts disposed within said container for counter-rotational movement therebetween. Working tools are attached to the shafts by radially extending arms and extend toward and substantially up to the side walls of the container. The working tools are double wedge shaped having substantially triangularly shaped sides converging toward each other at their connection to the shafts and converging toward each other to define a forward or leading edge in the direction of rotation of the tool. The bottom surfaces of the tools are recessed from the bottom edges of the triangularly shaped sides. The parallel adjacent shafts are arranged so that the paths of the working tools of each shaft overlap so that the tools mounted on each shaft come in proximity to the adjacent shaft thereby creating an overlapping zone of interaction for positive movement of material with uniform rate of shear. In order to convey material toward a discharge or an out-feed opening, the working tools are asymmetrically designed to induce material flow toward the opening.

According to the method of the present invention for discharging or feeding difficult-to-handle or difficult-to-flow material by "mass flow" from storage bins, the steps comprise interacting the material between a pair or pairs of oppositely driven shafts in a container connected to the bottom of a storage bin with working tools so that mechanical forces are applied through the working tools to induce "mass flow" through the bin and move individual particles and layers of material in oblique directions, the forces and components exerted in directions circularly, laterally and with the greater component force inducing flow through the discharge or the out-feed opening, as the case may be; radially inverting the individual particles of divided materials so as to change their direction, paths of travel and velocities so that the mechanical shear forces imparted by the working tools, as well as the hydraulic shear forces created by the particles slipping on each other by their different velocities, are averaged over an extremely short period of time; averaging and making uniform the shear stresses resulting from the mechanical and hydraulic shear forces for each particle whereby, as a result of the uniform work input, uniform temperature gradient if mechanical energy is converted to heat energy, uniform shear stress, a uniform and predictable viscosity, a uniform bulk density, a non-classified material, and "mass flow" are provided for discharging a storage bin at a constant rate of flow or discharging a storage bin at a controllable, variable rate of flow.

Other objects and features of the present invention will become apparent from the following detailed description considered in connection with the accompanying drawings. It is to be understood, however, that the drawings are designed as an illustration only and not as a definition of the limits of the invention.

In the drawing wherein similar reference characters denote similar elements throughout the several views:

FIG. 1 is a plan view of a bin-discharger for mechanically inducing flow of difficult-to-handle materials from storage bins embodying the present invention;

FIG. 2 is a cross sectional view of the bin-discharger of FIG. 1 taken along line 2—2 of FIG. 1;

Figure 3:
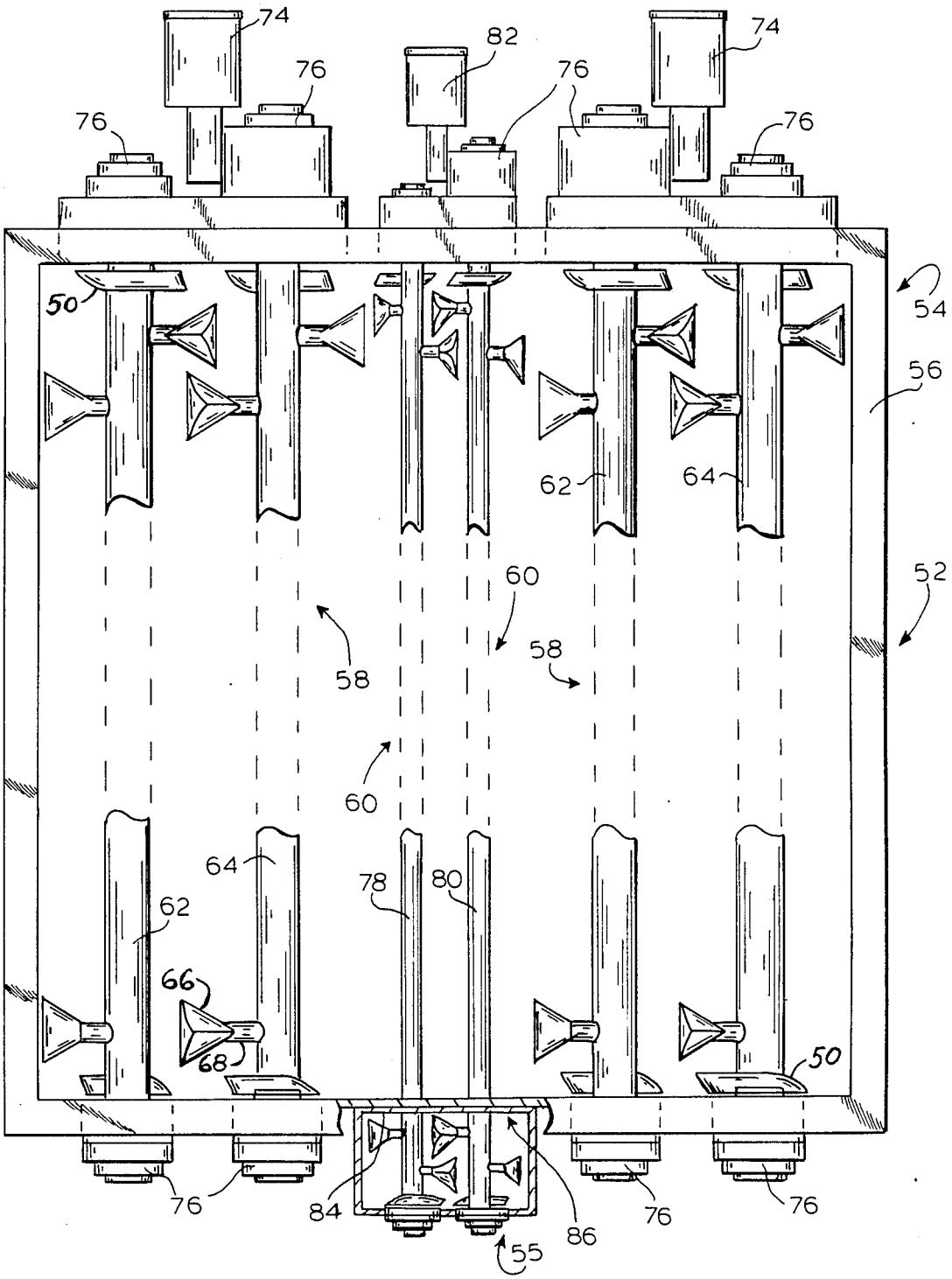
FIG. 3 is a plan view of a bin-discharger-feeder for mechanically inducing flow of difficult-to-handle materials from storage bins embodying the present invention.

Now turning to the drawings, there is shown in FIG. 1 a bin-discharger embodying the present invention, generally designated 10, which includes a container or so called bin bottom, designated 12, having a flange 14 along the top peripheral edge thereof for attaching container 12 to the bottom of a bin (see FIG. 2). Two parallel, horizontally spaced apart shafts, designated 16 and 18, are rotatably mounted in container 12 and each is provided with a plurality of working tools, generally designated 20, connected to each shaft 16 and 18 by means of radially extending connecting arms 22. Working tools 20 are radially arranged on shafts 16 and 18 at equal angular displacements over the 360° circumference of the shafts. In addition, shafts 16 and 18 are displaced from one another by 180° so that the working tools on the respective shafts are likewise displaced by 180°. Shafts 16 and 18 are each mounted for rotation between pairs of bearings, designated 24 and 26, respectively, and are driven by motor 28. Motor 28 drives shafts 16 and 18 counter rotationally by means of spur gears mounted in spur gear housing 30. Where shafts 16 and 18 pass through the end plates of container 12, packings are provided in packing housings 32. For discharging the material from container 12, a flanged, cylindrically shaped discharge outlet 34 is provided centrally positioned in the bottom of container 12.

As clearly seen in FIG. 2, container 12 may be attached along its flange 14 to a corresponding flange 15 of a storage bin 17. Container 12 is comprised of trough portions, designated 36, in the form of two intersecting cylindrical chambers having shafts 16 and 18 defining their axial centers. The cylindrical chambers intersect at the area defined by the overlapping of the respective working tools 20 driven by shafts 16 and 18. The lengths of connecting arms 22 are such that tools 20 extend substantially up to the cylindrically shaped bottom of each chamber 36 of container 12 as well as substantially up to the opposing adjacent shaft 16 or 18, as the case may be.

Working tools 20, as clearly seen in FIGS. 1 and 2, are preferably wedge shaped or triangularly shaped having substantially triangularly shaped sides, designated 38 and 40, which converge toward each other at their connection with connecting arm 22 and converge toward each other to define a forward or leading edge, designated 42. Forward edge 42 of tool 20 is in the direction of rotational movement of the tool. The bottom surface of tool 20, designated 44, is recessed with respect to the bottom edges of triangularly shaped sides 38 and 40 and substantially parallel to the internal surface or wall of trough 36. Sufficient working tools are provided on shafts 16 and 18 to sweep the complete inner surface of container 12. The bottom surface 44 of tool 20 is configured to pull material off the container walls due to the creation of a differential pressure between the bottom surface of the tool and the walls of trough 36 resulting from the rotation of tool 20. This pressure differential results from the airfoil-like design of tool 20 and tends to remove material from the walls of the container without compression and undue shear force. The design of such a working tool is covered by my earlier patent entitled "METHOD AND APPARATUS FOR MIXING VISCOUS MATERIALS", U.S. Pat. No. 3,941,357, granted Mar. 2, 1976. As described in my prior patent such tools, in a mixing apparatus which employs horizontally spaced apart, parallel, counter rotating shafts carrying the tools, interact the material between the pair of oppositely driven shafts, so that mechanical forces are applied through the working tools to move individual particles and layers of material in oblique directions, the resultant force having component forces exerted in directions circularly, laterally, and toward the center of the container. The individual particles are randomly divided by means of the working tools which impart varying velocity and varying velocity paths to the particles so as to promote constant and positive circulation of all particles of the batch. The individual particles of material are radially inverted so as to change their direction, paths of travel and velocity so that mechanical shear forces imparted by the working tools, as well as hydraulic shear forces created by the particles of material slipping on each other by their different velocities, are averaged over an extremely short period of time. The shear stresses resulting from the mechanical and hydraulic shear forces for each particle, are averaged and made uniform whereby as a result of the uniform work input, uniform temperature gradient, uniform shear stress, a uniform and predictable viscosity throughout the complete batch of shear sensitive material is provided.

Figure 6:
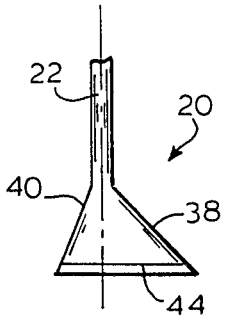
FIG. 6 is an enlarged rear elevational view of an asymmetrical double wedge shaped working tool.

In order to move or convey material which is being acted on by such tools toward a discharge opening, such as discharge outlet 34 in container 12, tools 20 must exert a greater force component in the direction of the discharge opening so as to induce material flow toward the opening. In order to accomplish this, tool 20, as clearly seen in FIG. 6, is asymmetrical having one of its sides 38 or 40 at the optimum angle of 45° which is the angle at which the maximum amount of material is moved by the tool. The other side of tool 20 has a more shallow angle with respect to the vertical which results in less of the material being moved by this side. Thus, with a series of such tools 20 arranged along shafts 16 and 18, the material will be induced to flow in the direction in which the 45° angled sides of tools 20 are arranged. It is to be noted that 45° is the optimum angle and the material will be induced to flow in the direction in which the greater angled sides up to the optimum are arranged.

As clearly seen in FIG. 1, in order to prevent material build up on the end plates 46 and 48 of container 12, single or half wedge shaped tools 50 are provided at the ends of shafts 16 and 18. Tools 50 effectively scrape end plates 46 and 48 and return the material therefrom towards the center of container 12 to be acted upon by working tools 20.

In the case of bin-discharger 10 having a centrally located discharge opening 34, right hand and left hand asymmetrical working tools 20 are mounted on the same shaft. Material being induced to flow from the storage bin, when coming in contact with the triangular sides 38 and 40 of working tools 20, is imparted with forces that move material circularly, laterally and into the zone of interaction defined by the overlapping of tools 20 carried by shafts 16 and 18. This results in a vigorous interaction and comingling of material which unifies the density and assures that classifiable material does not classify. In addition to these actions, there is a reflux action which causes particles to move from side to side and end to end of the discharger with a resultant force, or component of force, that assures movement at constant rate to the discharge opening 34 by means of the asymmetrical design and arrangement of the asymmetrical working tools as illustrated in FIG. 1. These combined actions result in inducing "mass flow" through the storage bin. When the discharge opening is at the side of container 12, all asymmetrically mounted working tools 20 will have a component of force which will move material longitudinally toward the side discharge opening.

Figure 4:
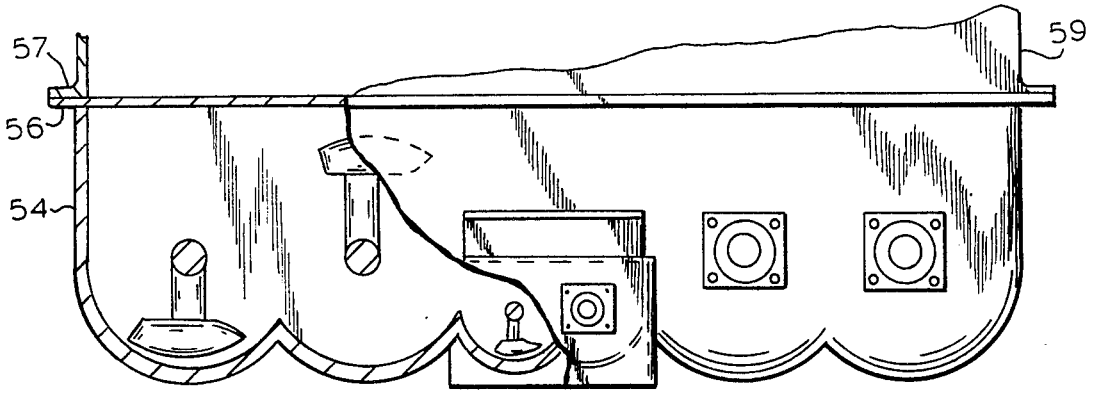
FIG. 4 is a front elevational view of the bin-discharger-feeder of FIG. 3 shown partly in cross section.
Figure 5:
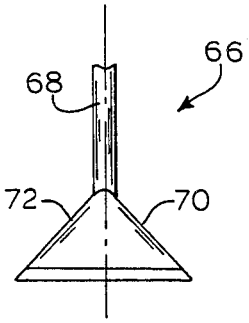
FIG. 5 is an enlarged rear elevational view of a symmetrical, double wedge shaped working tool.

There is shown in FIG. 3 a bin-discharger-feeder 52 which includes a container 54 having a flanged top 56 for connecting container 54 to the bottom of a storage bin (see FIG. 4). Container 54 has mounted therein a parallel series of overlapping shaft assemblies arranged in pairs comprising discharger-mixer assemblies 58 and a feeder assembly 60. At least two discharger-mixture assemblies 58 are arranged one on either side of feeder assembly 60 and each comprises two counter rotating shafts 62 and 64 having overlapping working or mixing tools 66 mounted thereon by means of arms 68. Mixing tools 66 of discharger-mixer assemblies 58 are designed to be symmetrical, as clearly seen in FIG. 5, with their sides 70 and 72 preferably defining the optimum angle of 45° and induce flow to feeder assembly 60 with a corresponding "mass flow" through the storage bin. Each assembly 58 is driven by a single drive motor 74 and each shaft is provided with end bearings and packings 76. Feeder assembly 60 comprising oppositely driven shafts 78 and 80 is driven by a motor 82 which may be an SCR-DC variable speed motor or other type of variable speed drive, adapted to alter the rotational speed of shafts 78 and 80. All motors 74 are constant speed low rpm, from $\frac{1}{4}$ rpm to 90 rpm depending on the diameter of the shaft assembly or the nature of the material such as weight, viscosity or cohesiveness. The low and constant speed of motors 74 provides high torque to working tools 66 as well as conservation of electrical energy.

As clearly seen in FIG. 4, container 54 may be attached along its flange 56 to a corresponding flange 57 of a storage bin 59. The shafts of each assembly 58 and 60 define the centers of cylindrically shaped intersecting chambers in a manner similar to that shown in connection with FIGS. 1 and 2. The asymmetrical working tools 20 of feeder assembly 60 are arranged to induce material flow toward an out-feed, designated 84, in the end of container 54 which may be defined by adjustable slide gate 86. Such an adjustable slide gate 86 may be used in conjunction with the adjustable rates of rotation of shafts 78 and 80 to vary the amount of material discharged or fed from out-feed opening 84. The action of bin-discharger-feeder 52 is similar to that of the bin-discharger of FIG. 1, that is, material is imparted with forces to move the material circularly, laterally, with reflux action while interchanging material uniformly between shaft assemblies thereby promoting and inducing mass flow through the storage bin with the greater force exerted by asymmetrical working tool 20 to induce flow toward out-feed 84. The interacting of material between pairs of oppositely driven working tools, with random dividing and comingling by means of said working tools so as to promote constant and positive circulation of all particles, with radial inversion of the individual particles of the material so as to change their direction, paths of travel and velocities so that the mechanical shear forces imparted by the working tools, as well as the hydraulic shear forces created by the particles of material slipping on each other by their different velocities, are averaged over an extremely short period of time. The result of the averaging and making uniform the shear stresses, a uniform viscosity of shear sensitive material results, even for the difficult-to-handle materials to which the instant invention is addressed. By adjustment of the rotational speed of feed assembly shafts 78 and 80 by motor 78 and/or adjustment of slide gate 80, the feed of material through bin-discharger-feeder 52 can be controlled and varied as desired.

As clearly seen in FIG. 3, single or half wedge shaped tools 50 are also provided at the ends of the shafts of assemblies 58 and 60 for the purpose of effectively scraping the end plates of container 54 to return the material therefrom towards the center of the container to be acted upon by the working tools.

While only a few embodiments of the present invention have been shown and described, it will be obvious that many changes and modifications may be made thereunto without departing from the spirit and scope of the invention.

What is claimed is:

1. A storage bin discharge apparatus for discharging difficult-to-handle materials from a storage bin, comprising:

(a) a container adapted to be attached to the bottom of a storage bin which contains difficult-to-handle materials;

(b) two parallel, horizontally spaced apart shafts disposed longitudinally and rotatably mounted in said container;

(c) means for rotating said shafts oppositely to one another in said container;

(d) a discharge opening in said container disposed along the longitudinal direction of said shafts; and (e) a plurality of working tools mounted on said shafts, each tool comprising two substantially triangularly shaped sides having bottom edges, said sides converging toward each other at their connection to the shaft and converging toward each other to define a forward edge in the direction of rotation of said tool thereby defining a double wedge shape, and a bottom face which is recessed from the bottom edges of said sides, said tools being mounted to said shafts so that the paths of travel of the tools of one shaft come into proximity to the other shaft so as to create an overlapping zone of interaction between the respective tools of said shafts, one side of each tool being disposed at an angle to a plane perpendicular to a plane which includes the axis of said shafts which angle is greater than the corresponding angle of the other side of said tool, the angle of said one side being no greater than the angle which moves the optimum amount of material, said tools being arranged on said shafts so that said one side of each tool is arranged in the direction of said discharge opening.

2. The storage bin discharge apparatus as defined in claim 1, wherein the angle of said one side of said working tool which moves the optimum amount of material is 45°.

3. The storage bin discharge apparatus as defined in claim 1, wherein said one side of each working tool is disposed at an angle of 45° to the vertical plane perpendicular to the plane which includes the axis of said shafts.

4. The storage bin discharge apparatus as defined in claim 1, wherein said discharge opening is arranged centrally in the bottom of said container and the working tools on each shaft are arranged so that the working tools disposed on one side of the discharge opening have their triangularly shaped sides facing the discharge opening disposed at a greater angle to a plane perpendicular to the plane which includes the axis of said shafts than their triangularly shaped sides facing away from the discharge opening, and the tools on the other side of the discharge opening have their triangularly shaped sides arranged oppositely thereto.

5. The storage bin discharge apparatus as defined in claim 1, wherein said working tools on each shaft are arranged along the 360° circumference of the shaft at equal angular displacements and each shaft is displaced from the other by 180° so that the corresponding working tools on each shaft are displaced from each other by 180°.

6. The storage bin discharge apparatus as defined in claim 1, wherein said container comprises two cylindrically shaped chambers which intersect between the axes of said shafts to form the bottom of said container, the axes of said shafts being disposed along the axes of said cylinders, and said working tools extending from said shafts toward and substantially up to the bottom of said cylindrical chambers so that the bottom face of each tool is substantially parallel to the inside surface of said cylindrically shaped chambers.

7. The storage bin discharge apparatus as defined in claim 1, which further includes a half wedge shaped working tool disposed at each end of said shafts to scrape material from the end walls of said container and direct the material to the interior of said container.

8. The storage bin discharge apparatus as defined in claim 1, wherein said rotating means is adjustable so as to adjust the rotational speed of said shafts.

9. The storage bin discharge apparatus as defined in claim 8, which further comprises an adjustable slide gate at said discharge opening to adjust said opening.

10. The storage bin discharge apparatus as defined in claim 8, which further comprises a plurality of discharger-mixer assemblies evenly arranged on either longitudinal side of said parallel shafts having said material moving working tools mounted thereon, each assembly comprising two parallel, horizontally spaced apart shafts disposed parallel to the shafts having the material moving working tools mounted thereon and rotatably mounted in said container; means for rotating said shafts at a constant rate oppositely to one another in said container; and a plurality of mixing tools mounted on said shafts, each tool comprising two substantially triangularly shaped sides converging toward each other at their connection to the shaft and converging toward each other to define a forward edge in the direction of rotation of said tool thereby defining a double wedge shape, the bottom face of said tool being recessed from the bottom edges of said sides, said tools being mounted to said shafts so that the paths of travel of the tools of one shaft come in proximity to the other shaft so as to create an overlapping zone of interaction between the respective tools of said shafts for the rapid impelling and dividing of the material being processed;

whereby the mixing tools induce material flow to the material moving working tools with corresponding mass flow through the storage bin and the material moving working tools receive and exchange material with the discharger-mixer assemblies inducing forces to move individual particles or layers of material in oblique directions, the resultant forces having components exerted in directions circularly, laterally in both directions with the greater force exerted by said working tools to induce flow toward said discharge opening.

11. The storage bin discharge apparatus as defined in claim 10, wherein the angle of said one side of said working tool which moves the optimum amount of material is 45°.

12. The storage bin discharge apparatus as defined in claim 10, wherein said one side of each working tool is disposed at an angle of 45° to the vertical plane perpendicular to the plane which includes the axis of said shafts.

13. The storage bin discharge apparatus as defined in claim 10, wherein said working tools on each shaft are arranged along the 360° circumference of the shaft at equal angular displacements and each shaft is displaced from the other by 180° so that the corresponding working tools on each shaft are displaced from each other by 180°.

14. The storage bin discharge apparatus as defined in claim 13, wherein the mixing tools on their respective shafts are arranged along the 360° circumference of each shaft at equal angular displacements and each shaft of each discharger-mixer assembly is displaced from the other shaft by 180° so that the corresponding mixing tools on each shaft of the discharger-mixer assembly are displaced from each other by 180°.

15. The storage bin discharge apparatus as defined in claim 10, which further comprises an adjustable slide gate at said discharge opening to adjust said opening.

* * * * *